US007958682B2

(12) United States Patent
Elzein

(10) Patent No.: US 7,958,682 B2
(45) Date of Patent: Jun. 14, 2011

(54) WINDOW FILM ANCHORING DEVICE

(75) Inventor: Sam Elzein, Columbus, OH (US)

(73) Assignee: Innovative Security Concepts, Dublin ( * ) Notice: Subject to any disclaimer, the term of this patent is extended or adjusted under 35 U.S.C. 154(b) by 170 days.

(21) Appl. No.: 12/369,386

(22) Filed: Feb. 11, 2009

(65) Prior Publication Data

US 2010/0199579 A1 Aug. 12, 2010

(51) Int. Cl.

| | |
|---|---|
| ***E06B 3/964*** | (2006.01) |
| ***E06B 3/30*** | (2006.01) |
| ***E06B 1/34*** | (2006.01) |
| ***E06B 5/11*** | (2006.01) |
| ***E06B 5/10*** | (2006.01) |

(52) U.S. Cl. ..... 52/204.53; 52/203; 52/204.62

(58) Field of Classification Search ..... 52/204.53, 52/204.591, 204.599, 204.62, 204.64, 204.7, 52/312, 717.01, 717.03, 717.05, 718.03, 52/202, 203, 204.69, 468; 24/291, 293, 297, 24/304, 546

See application file for complete search history.

(56) References Cited

U.S. PATENT DOCUMENTS

| | | | | | |
|---|---|---|---|---|---|
| 2,016,968 | A | * | 10/1935 | Marble | 52/418 |
| 2,230,688 | A | * | 2/1941 | Irwin | 404/65 |
| 3,144,689 | A | * | 8/1964 | Migneault et al. | 52/773 |
| 3,200,547 | A | * | 8/1965 | Johnson | 52/287.1 |
| 3,271,232 | A | * | 9/1966 | Moore | 428/130 |
| 3,339,329 | A | * | 9/1967 | Berg | 52/395 |
| 3,352,217 | A | * | 11/1967 | Peters et al. | 404/65 |
| 3,388,517 | A | * | 6/1968 | Wohl et al. | 52/204.591 |
| 3,408,250 | A | * | 10/1968 | Finefrock | 428/121 |
| 3,760,544 | A | * | 9/1973 | Hawes et al. | 52/468 |
| 4,067,155 | A | * | 1/1978 | Ruff et al. | 52/105 |
| 4,147,006 | A | * | 4/1979 | Kruschwitz | 52/204.599 |
| 4,233,790 | A | * | 11/1980 | Meadows | 52/222 |
| 4,320,609 | A | * | 3/1982 | Abell | 52/202 |
| RE30,930 | E | * | 5/1982 | Trachtenburg et al. | 52/309.3 |
| 4,362,427 | A | * | 12/1982 | Mass et al. | 404/64 |
| 4,438,609 | A | * | 3/1984 | Nielson et al. | 52/208 |
| 4,441,755 | A | * | 4/1984 | Endo et al. | 296/93 |
| 4,502,259 | A | * | 3/1985 | Smith | 52/208 |
| 4,533,278 | A | * | 8/1985 | Corsover et al. | 404/65 |
| 4,598,525 | A | * | 7/1986 | Poore | 52/204.705 |

(Continued)

FOREIGN PATENT DOCUMENTS

CH 676276 A5 * 12/1990

(Continued)

*Primary Examiner* — Robert J Canfield

(74) *Attorney, Agent, or Firm* — Gallagher & Dawsey Co., LPA; Michael J. Gallagher; David J. Dawsey

(57) ABSTRACT

A window film anchoring having at least one film retaining limb, one frame retaining limb and central area, with the central area disposed between the at least one film retaining limb and the at least one frame retaining limb. In some embodiments, the device may have at least one anchor limb confluent with the central area working surface with at least one anchor ridge releasably engagable with at least one portion of a window frame. Windows barbs and anchor barbs may help attachment the device in use. In some embodiments, the body has a uniform material composition throughout, and may be attachable with double-sided tape, particularly with a heat activated double-sided tape. In another embodiment, the window film anchoring device may have a body with at least one film retaining limb at least one frame retaining limb and at least one central area having at least one bend promoting area.

15 Claims, 8 Drawing Sheets

U.S. PATENT DOCUMENTS

| | | | | | |
|---|---|---|---|---|---|
| 4,601,149 | A | * | 7/1986 | Dokan | 52/287.1 |
| 4,873,803 | A | * | 10/1989 | Rundo | 52/202 |
| 4,877,673 | A | * | 10/1989 | Eckel et al. | 428/172 |
| 5,045,374 | A | * | 9/1991 | Tucker | 428/83 |
| 5,155,952 | A | * | 10/1992 | Herwegh et al. | 52/100 |
| 5,197,250 | A | * | 3/1993 | Kramer | 52/396.04 |
| 5,343,662 | A | * | 9/1994 | Nelson | 52/208 |
| 5,549,346 | A | * | 8/1996 | Gold | 296/93 |
| 5,705,002 | A | * | 1/1998 | Sherry | 156/71 |
| 5,953,881 | A | * | 9/1999 | Sherry | 52/746.1 |
| 5,992,107 | A | | 11/1999 | Poirier | |
| 6,047,500 | A | * | 4/2000 | Caplette | 49/466 |
| 6,105,973 | A | * | 8/2000 | Butler et al. | 277/644 |
| 6,219,982 | B1 | * | 4/2001 | Eyring | 52/396.04 |
| 6,729,092 | B2 | * | 5/2004 | Grosjean | 52/395 |
| 6,832,457 | B2 | * | 12/2004 | Geiger | 52/656.5 |
| 6,931,799 | B2 | | 8/2005 | Webb | |
| 6,991,400 | B1 | * | 1/2006 | Negueloua | 404/56 |
| D552,269 | S | * | 10/2007 | Vibiano et al. | D25/164 |
| 7,784,238 | B2 | * | 8/2010 | Bannister | 52/465 |
| 2002/0011040 | A1 | * | 1/2002 | Adachi et al. | 52/204.597 |
| 2006/0056449 | A1 | * | 3/2006 | Morioka | 370/466 |
| 2009/0056246 | A1 | * | 3/2009 | Prince et al. | 52/204.53 |
| 2009/0151255 | A1 | * | 6/2009 | Haak et al. | 49/9 |

FOREIGN PATENT DOCUMENTS

| | | | |
|---|---|---|---|
| EP | 0 369 085 | A1 * | 5/1990 |

* cited by examiner

WINDOW FILM ANCHORING DEVICE

TECHNICAL FIELD

The instant invention relates to a window film anchoring device for fragment retention film, in particular, for a glass fragment retaining film anchoring device having, in some embodiments, a mechanical attachment to glass mounting devices such as window framing.

BACKGROUND OF THE INVENTION

Glass, especially glass used in windows and doors, is ubiquitous in the modern world. Glass is an integral part of almost all buildings such as businesses, schools, hospitals, hotels and restaurants. Glass windows and doors are used to supply natural light and to provide visibility both into and out of structures. Unfortunately, having glass windows, especially if they entail large areas of glass, can cause some unwanted problems.

Glass windows and doors are a major entry point for break-ins and robberies. Additionally, glass windows are highly vulnerable to extreme weather and even blast effects form industrial accidents or terrorist activity. In particular, many window and door glasses are prone to shattering into countless number of potentially deadly shards of airborne pieces. One solution has been to utilize laminated, or so-called "safety" glass, which generally has a plastic layer laminated between two glass layers. Such laminated glass is very expensive, difficult to retrofit in many applications, and while it strengthens the glass portion of a window or door, does not increase the resistance of the glass portion to being blown out of its framing.

Another solution employed in past, especially in attempts to retrofit existing glass for greater safety, has been the addition of a polyester safety film. Such a film does not significantly change the propensity of glass to shatter into multiple pieces, but does a reasonable job in holding the glass fragments together in case of breakage. Such films are commonly know as "safety films" or "fragment retention films." Holding glass shards together does improve the safety aspects, but especially does not necessarily produce a more secure environment. For example, it is not uncommon, after severe weather or a blast incident, to find that the entire window pane has been blown out of a window frame.

In the past, fragment retention films have often been anchored by means of double-faced tape strips with plastic backings, such as that taught by U.S. Pats. Nos. 5,992,107 and 6,931,799. The double-faced tape is employed to secure the strip to both the glass and the glass frame, and the plastic strip is employed to provide strength to the assembly. These assemblies are fraught with problems. Firstly, because the strip material that may be bonded to the glass is insufficiently strong, a flexible first strip material is generally bonded to a less-flexible second strip material for strength. This may produce adverse effects on flexibility. Secondly, prior art strips are generally, if not exclusively, taught as internal mounted fixtures, due to the weather-bearing inadequacies of the often-PVC strip materials. In additions, and corrected in an additional embodiment of the present invention, these adhesive strip devices lack a mechanical anchor to the window frame.

However, such adhesive-only, relatively inflexible, mounting assemblies are only as reliable as the film to strip adhesion, and the frame to strip adhesion. This can be a particular problem as surface conditions of the glass frame, such as roughness or low adhesion surfaces may intrinsically compromise safety. In addition, adhesive bonds are affected by such environmental parameters as temperature, and by expansion and contraction movement of the glass within the frame.

The instant invention addresses these, and other problems, in unique and effective ways, as are detailed below.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The device may generally have a body including at least one film retaining limb, at least one frame retaining limb and at least one central area, with the central area disposed between the at least one film retaining limb and the at least one frame retaining limb.

In some, but not all embodiments, the device may have at least one anchor limb confluent with the central area working surface that may further have at least one first anchor ridge with at least one first anchor barb releasably engagable with at least one portion of a window frame. The at least one anchor limb may further include a second anchor ridge releasably engagable with at least one portion of a window frame. In fact, this specification intends that no absolute upper limit be set on the number of anchor ridges, nor any limitation on the size or configuration of any such anchor ridges that may be incorporated into any embodiment. In some embodiments, the body has a uniform material composition throughout. In others, the body may include two or more sub-parts of varying composition.

A wide variety of materials may be useful in the composition of the body, such as, by way of example only, polypropylene based thermoplastic elastomers. However, it is specifically envisioned that other materials or suppliers may perform at least as well or better in various applications, and no particular materials are excluded by this teaching.

In certain embodiments, again by way of example and not limitation, certain performance standards, as measured by standards of ASTM International (originally known as the American Society for Testing and Materials or ASTM), that are usually known to those skilled in the art and expressed as "ASTM" standards, have been found useful in establishing desired performance parameters. These include, and the following is not intended as an exhaustive compendium of such standards, as a flow direction tensile strength according to ASTM D412 of at least 5.0 MPa.; a flow direction elongation at break according to ASTM D412 of at least 350%; a cross direction tensile strength according to ASTM D412 of at least 7.0 MPa.; a cross direction elongation at break according to ASTM D412 of at least 500%; and/or, a cross-direction unnicked tear strength according to ASTM D624 of at least 35 kN/m.

In certain embodiments, while any method known to the art may be employed to attach the device to the window film and window frame, a film retaining limb adhesive means and a frame retaining limb adhesive means may both be a double-sided adhesive tape. In additional embodiments, the double-sided adhesive tape may be a heat activated double-sided adhesive tape.

In some embodiments, but not all, an anchor barb may be located on any part of an anchor ridge. In certain embodiments, the anchor barb may have a first anchor barb axis that is non-orthogonal to the first anchor ridge axis, thus creating a window barb proximal base angle and a window barb distal base angle with different angular measurements. Such an angle may help tension the device against the window film, window frame, or both. In other embodiments, the proximal base angle and the distal base angle may have the same angular measurement, i.e., the first anchor barb axis may be orthogonal to the first anchor ridge axis.

In some embodiments, the at least one first anchor ridge may have a sagittate-shaped (i.e., "arrow head" shape) combined anchor profile having a first basal lobe and a second basal lobe. The first basal lobe may further include a window barb and the second basal lobe may further include an anchor barb. In certain embodiments, the first basal lobe and the second basal lobe may be asymmetric about the first anchor ridge axis.

As taught here, there are no limitations necessarily present as to the number of, size, or configuration of window barbs and anchor barbs in those embodiments where such structures are present. There may be more than a single window barb, when such a structure is present, and there may be more than one anchor barb when such a structure is present. Window and anchor barbs may be directed in the same, or in different directions, and if in the same direction, need not be parallel.

In certain embodiments, the window film anchoring device may have, in an uninstalled position, a body having at least one film retaining limb and at least one frame retaining limb that may lie, in such an uninstalled position, in a substantially coplanar relationship to one another. The at least one film retaining limb and at least one frame retaining limb may be joined by at least one flexible one central area having at least one anchor limb joined at a non-zero angle to a central area working surface of the central area. In an installed position, the device may be changed in configuration such that the at least one film retaining limb and the least one frame retaining limb are in a substantially non-coplanar relationship to one another, while, in such an installed position, the film retaining limb and the anchor limb may be in a substantially coplanar relationship. The at least one film retaining limb may be attached to a fragment retention film, and the at least one frame retaining limb may be attached to a window frame. While in many embodiments this attachment may be adhesive, one skilled in the art will recognize a vast array of attachment methods, including but not limited to such as magnetic, releasable mechanical, and permanent mechanical.

In another embodiment, the window film anchoring device may have a body with at least one film retaining limb at least one frame retaining limb and at least one central area having at least one bend promoting area.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, all shown not-to-scale:

Figure 1:
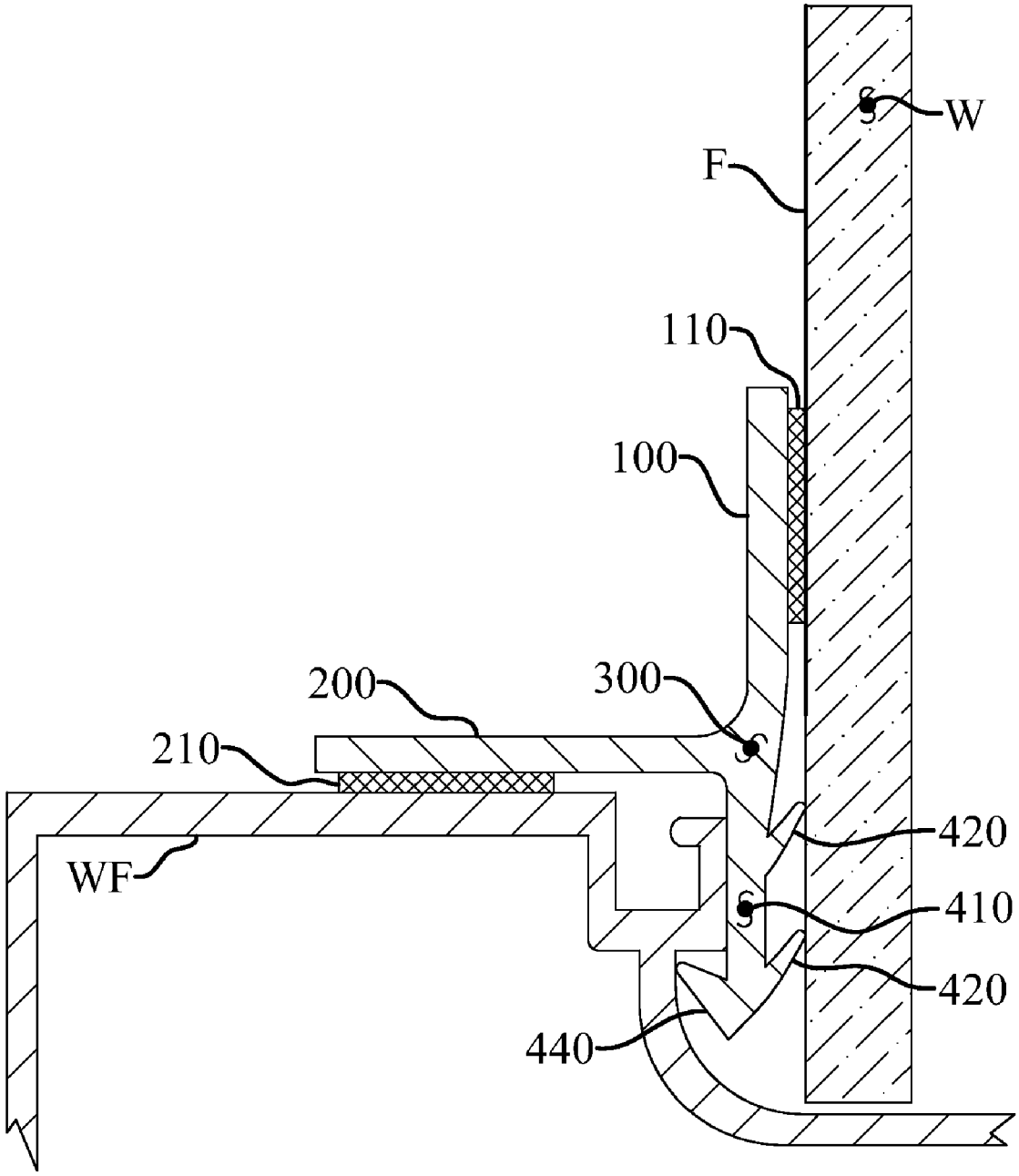
FIG. 1 shows a cross-sectional view of an embodiment of the instant invention, in an installed position.
Figure 2:
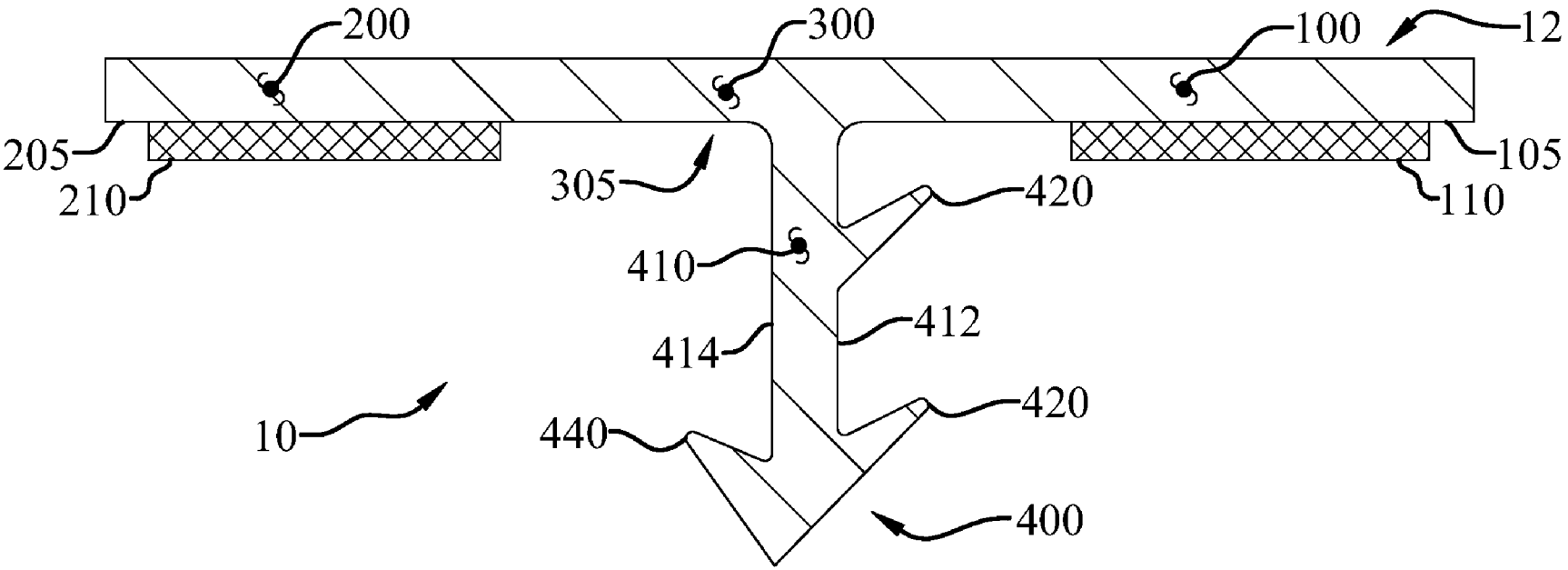
FIG. 2 shows a cross-sectional view of an embodiment of the instant invention, in an uninstalled position.
Figure 3:
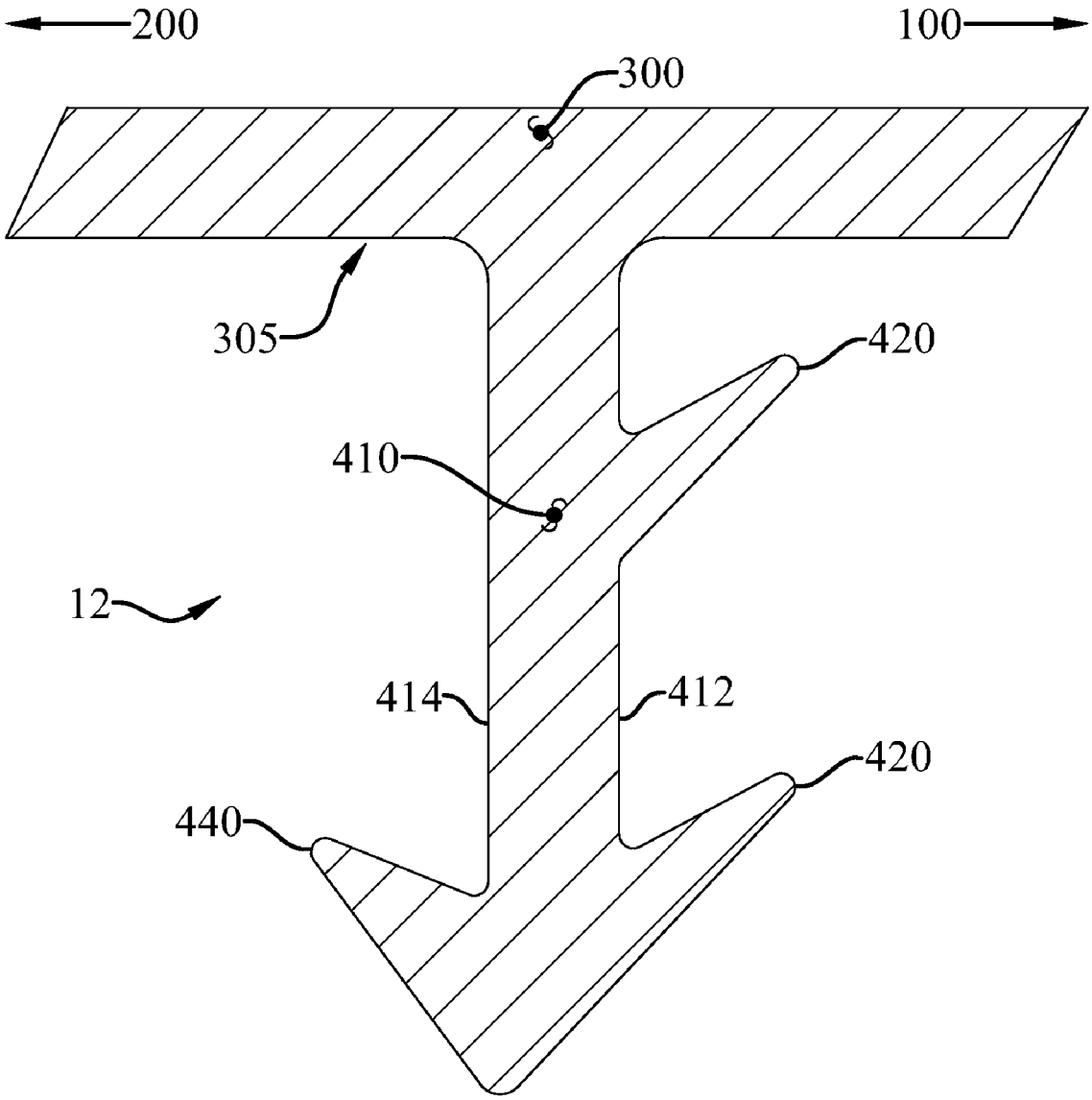
FIG. 3 shows a cross-sectional view of a portion of the embodiment of FIG. 2, in an uninstalled position.

These drawings, all not-to-scale, are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The window film anchoring device (10) of the instant invention enables a significant advance in the state of the art. The preferred embodiments of the device (10) accomplish this by new and novel arrangements of elements and methods that are configured in unique and novel ways and which demonstrate previously unavailable but preferred and desirable capabilities. The detailed description set forth below in connection with the drawings is intended merely as a description of the present embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

With regards to FIGS. 1-8, the device (10) may generally have a body (12) that further includes at least one film retaining limb (100) having at least one film retaining limb working surface (105) and a film retaining limb adhesive means (110) on at least a portion of at the least one film retaining limb working surface (105). There may also be at least one frame retaining limb (200) having at least one frame retaining limb working surface (205) and a frame retaining limb adhesive means (210) on a portion of at the at least one frame retaining limb working surface (205). There may be at least one central area (300) having at least a central area working surface (305), with the central area (300) disposed between the at least one film retaining limb (100) and the at least one frame retaining limb (200).

In some, but not all embodiments, as seen well in FIGS. 1-7, the device (10) may have at least one anchor limb (400) confluent with the central area working surface (305) that may further have at least one first anchor ridge (410) with at least one first anchor barb (440) releasably engagable with at least one portion of a window frame (WF). In other embodiments, seen well in FIGS. 4-6, the at least one anchor limb (400) may further include a second anchor ridge (450) releasably engagable with at least one portion of a window frame (WF). In fact, this specification intends that no absolute limit be set on the number of anchor ridges (450), nor any limitation on the size or configuration of any such anchor ridges (450) that may be incorporated into any embodiment. Again, in some embodiments, the body (12) has a uniform material composition throughout. In others, the body (12) may include two or more sub-parts of varying composition.

One skilled in the art will recognize that many variations and embodiments are possible, and that these are all intended to lie within the scope of the embodiments discussed specifically in this teaching.

In particular, a wide variety of materials may be useful in the composition of the body (12). In some embodiments, given for illustration and not limitation purposes only, it has been found that a polypropylene based thermoplastic elastomer, sold in the United States of America by DSM Thermoplastic Elastomers, Inc., of Leominster, Mass.; and internationally by DSM Thermoplastic Elastomers B.V. of The Netherlands, under the trademarked name SARLINK® X-5775B4, performs well. This teaching is not meant to imply that other materials or suppliers may not perform at least as well or better in various applications.

In certain embodiments, again by way of example and not limitation, certain performance standards, as measured by standards of ASTM International (originally known as the American Society for Testing and Materials, or ASTM), that are usually known to those skilled in the art and expressed as "ASTM" standards, have been found useful in establishing desired performance parameters.

By way of example only and not limitation, it has been found that a thermoplastic elastomer having a flow direction tensile strength according to ASTM D412 of at least 5.0 MPa. may be useful in practicing certain embodiments of the invention. Similarly, a thermoplastic elastomer having a flow direction elongation at break according to ASTM D412 of at least 350% may be useful in practicing certain embodiments of the invention. Additionally, a thermoplastic elastomer having a cross direction tensile strength according to ASTM D412 of at least 7.0 MPa. may be useful in practicing some embodiments of the invention, as may a thermoplastic elastomer having a cross direction elongation at break according to ASTM D412 of at least 500%. Lastly for illustration only, and not intending these ASTM standards to be the sole determinants of performance, a thermoplastic elastomer having a cross-direction unnicked tear strength according to ASTM D624 of at least 35 kN/m. may be useful in practicing some embodiments of the invention.

In certain embodiments, the film retaining limb adhesive means (110) and the frame retaining limb adhesive (210) means, such as may be seen in FIGS. 1, 2, 4, 5, and 7, may both be a double-sided adhesive tape. In additional embodiments, the double-sided adhesive tape may be a heat activated double-sided adhesive tape. As would be known to one skilled in the art, the use of heat-activated tape, may, in some circumstances, improve the adhesion between an adhesive tape and a difficult to adhere-to substrate. In some embodiments, given for illustration and not limitation purposes only, it has been found that a heat activated black acrylic foam double-sided tape, sold in the United States of America by The 3M Corporation, of St. Paul, Minn., under the name "3M™ Acrylic Plus Sealing Tape ST 1200," performs well in numerous applications.

In some embodiments, but not all, as taught above, an anchor barb (440) may be located on any part of an anchor ridge (410), as seen in FIGS. 1-7. In other embodiments, the at least one first anchor ridge (410), such as may be seen in detail in FIG. 7, may have a first anchor ridge axis (416) and a first anchor ridge first side (412), and a generally opposing first anchor ridge second side (414), where the first anchor ridge first side (412) may have at least one window barb (420).

Figure 7:
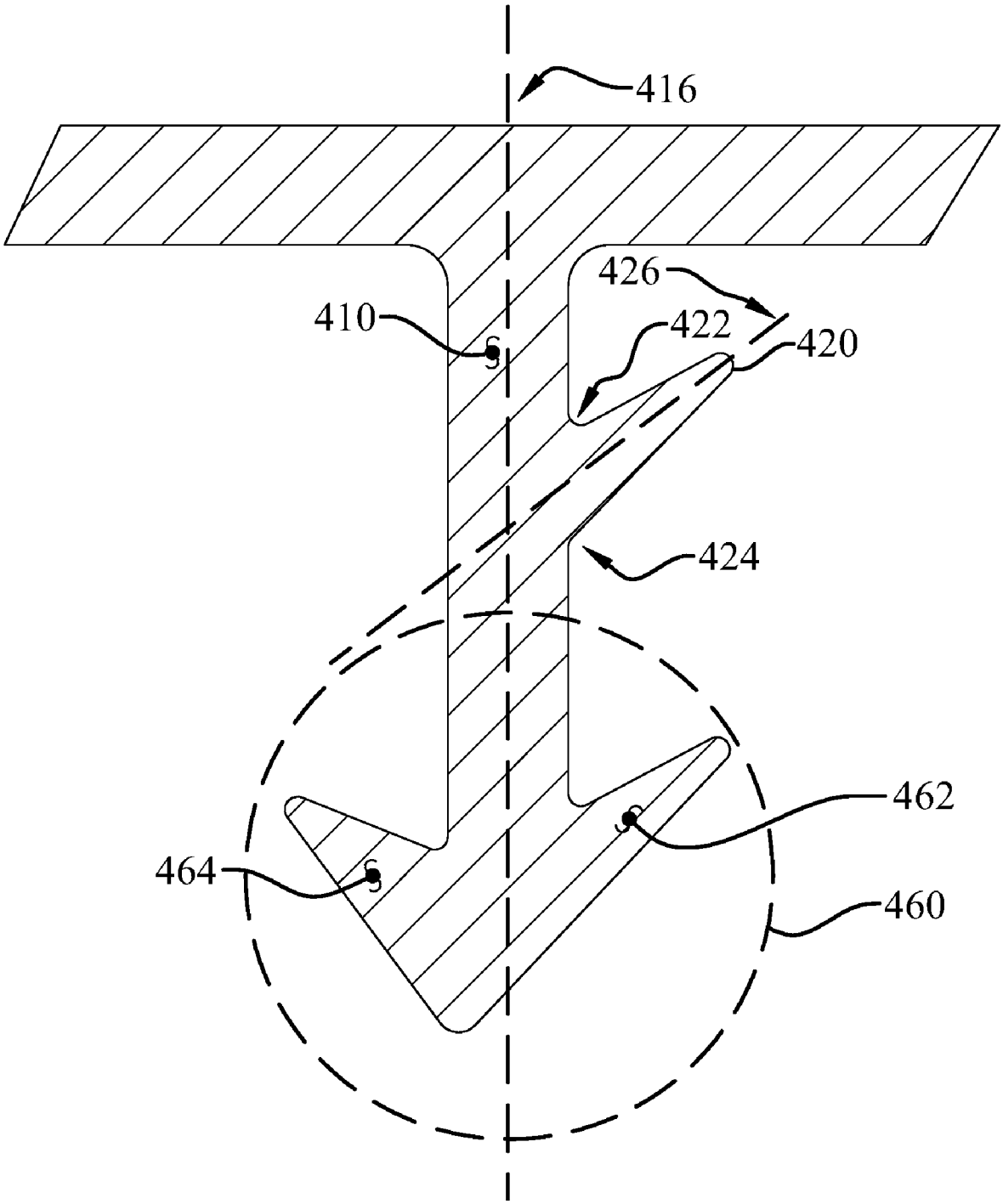
FIG. 7 shows a cross-sectional view of a portion of an embodiment of the instant invention, in an uninstalled position.

Again with particular reference to FIG. 7, in certain embodiments, the window barb (420) may have a first window barb axis (426) that is non-orthogonal to the first anchor ridge axis (416). Such a construction forms a window barb proximal base angle (422) and a window barb distal base angle (424), and in some, but not all embodiments envisioned, the proximal base angle (422) may be an acute angle and the distal base angle (424) may an obtuse angle. In other embodiments, these angular relationships may be reversed, that is, the proximal base angle (422) may be an obtuse angle and the distal base angle (424) may be an acute angle. In other embodiments, the proximal base angle (422) and the distal base angle (424) may have the same angular measurement, i.e., the first window barb axis (426) may be orthogonal to the first anchor ridge axis (416).

In some embodiments, and as illustrated in FIGS. 1-7, the at least one first anchor ridge (410) may have a sagittate-shaped (i.e., "arrow head" shape) combined anchor profile (460) having a first basal lobe (462) and a second basal lobe (464). The first basal lobe (462) may further include a window barb (420) and the second basal lobe (464) may further include an anchor barb (440). In certain embodiments, the first basal lobe (462) and the second basal lobe (464) may be asymmetric about the first anchor ridge axis (416).

Figure 6:
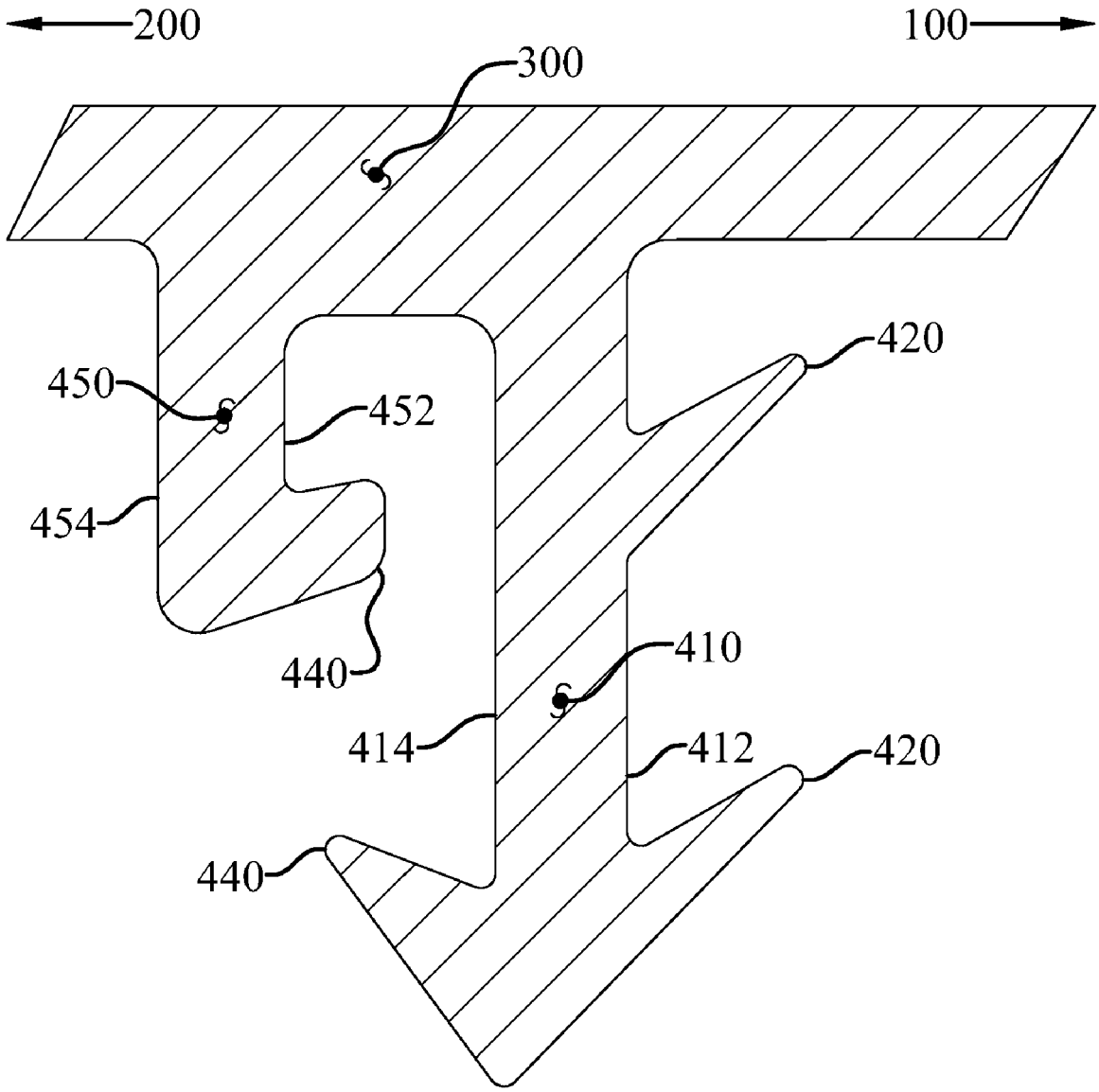
FIG. 6 shows a cross-sectional view of a portion of the embodiment of FIG. 5, in an uninstalled position.

As taught above there are no limitations necessarily present as to the number of, size, or configuration of window barbs (420) and anchor barbs (440) in those embodiment where such structures are present. For example, and not by way of limitation, in some embodiments, and as seen at FIG. 6, the at least one first anchor ridge (410) may have a first anchor ridge first side (412) and a generally opposing first anchor ridge second side (414), and the first anchor ridge first side (412) may have more than one window barb (420).

Again with reference to FIG. 6, in various embodiments, the at least one first anchor ridge (410) may have a first anchor ridge first side (412) and a generally opposing first anchor ridge second side (414), where the first anchor ridge first side (412) may have at least one window barb (420) and the first anchor ridge second side (414) may have at least one anchor barb (440).

Figure 4:
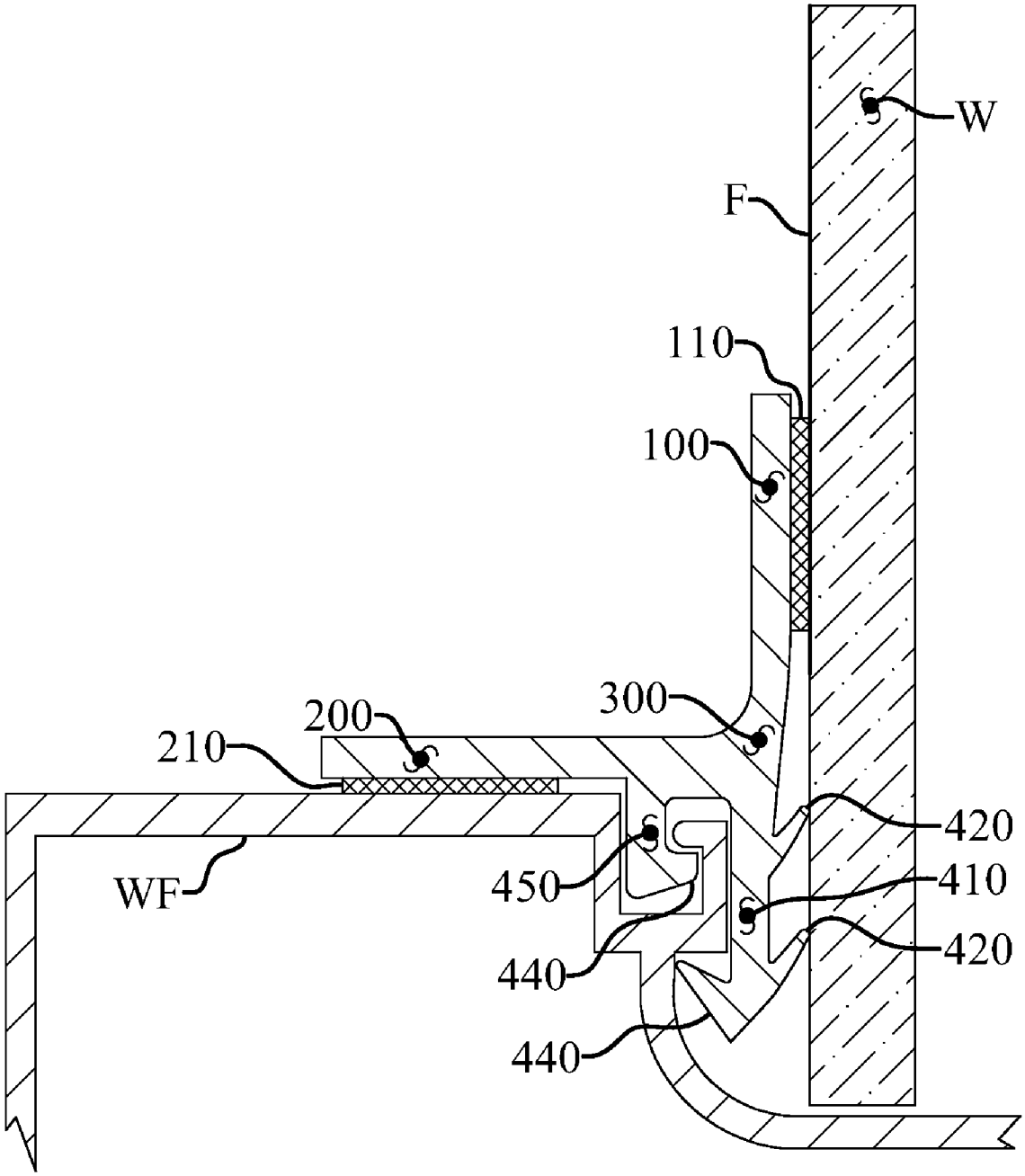
FIG. 4 shows a cross-sectional view of an embodiment of the instant invention, in an installed position.
Figure 5:
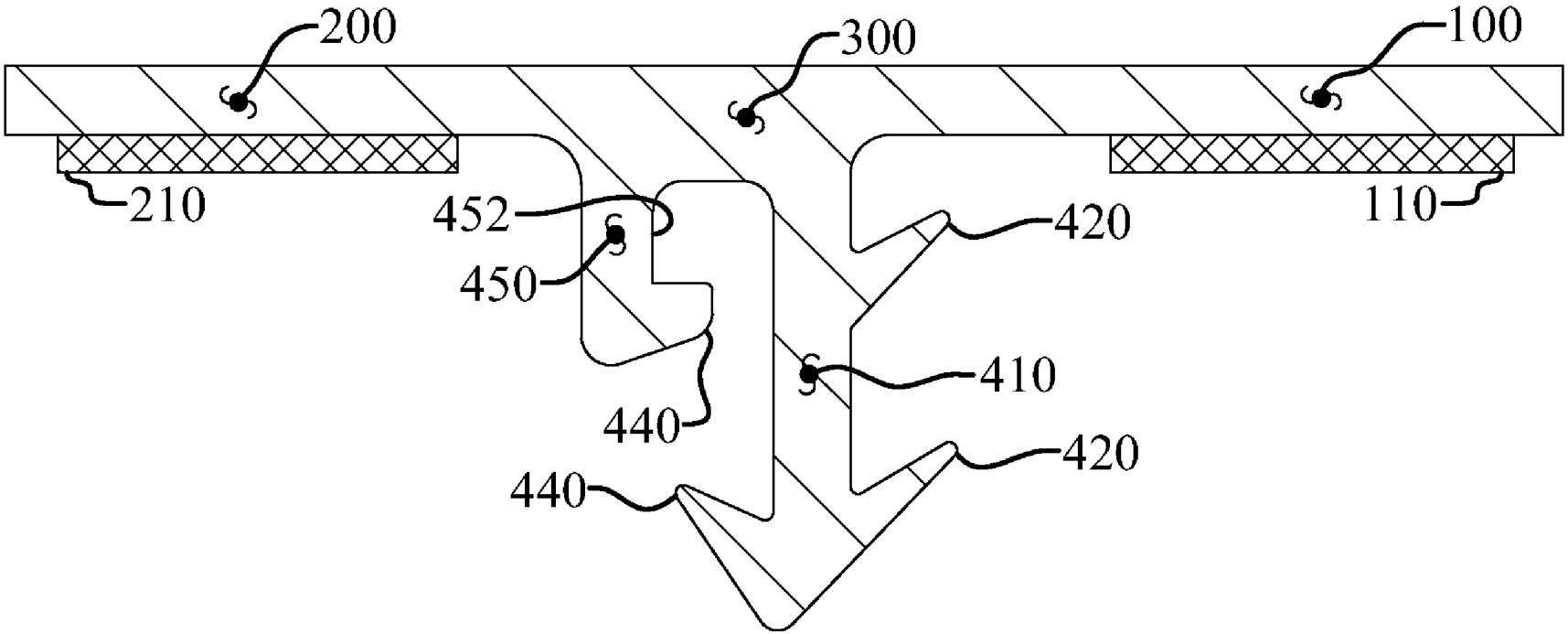
FIG. 5 shows a cross-sectional view of an embodiment of the instant invention, in an uninstalled position.

In differing embodiments that would be understood by one skilled in the art, in those embodiments having a second, or any number of additional anchor ridges (450), such as those illustrated in FIGS. 4 and 5, the second, or any additional anchor ridge (450), may have at least a second anchor ridge first side (452) and at least a second anchor ridge second side (454). The second anchor ridge first side (452) may be opposed to the first anchor ridge second side (414) and the second anchor ridge (450) may have least one anchor barb (440). In yet other embodiments, the second anchor ridge first side (452) may have at least one anchor barb (440).

Figure 8:
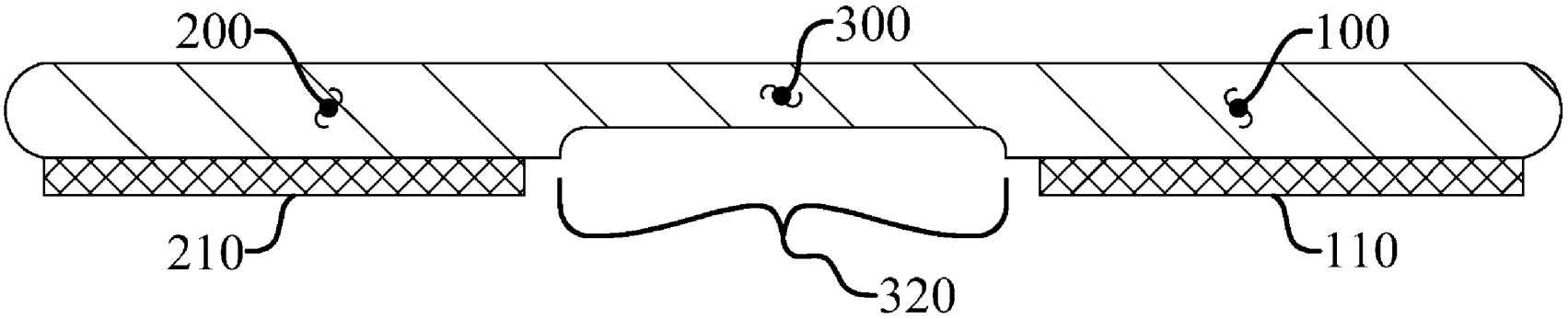
FIG. 8 shows a cross-sectional view of an embodiment of the instant invention, in an uninstalled position.

In another embodiment, seen well in FIG. 8, the window film anchoring device (10) may have a body (12) that further includes at least one film retaining limb (100) having at least one film retaining limb working surface (105) and a film retaining limb adhesive means (110) on at least a portion of at the least one film retaining limb working surface (105). Additionally, there may be at least one frame retaining limb (200) having at least one frame retaining limb working surface (205) and a frame retaining limb adhesive means (210) further comprising a heat-activated double sided adhesive tape on at least a portion of the at least one frame retaining limb working surface (205). The body may also have at least one central area (300) having at least one bend promoting area (320). A bend promoting area (320) may include an area thinned in thickness from one or both sides, may be a notch or other such attenuation in the surface, or may be any other bend promoting condition as would be known in the art.

In certain embodiments, seen well in FIGS. 1-7, as always intended for example and not limitation, the window film anchoring device (10) may have, in an uninstalled position, a body (12) having at least one film retaining limb (100) and at least one frame retaining limb (200). The at least one film retaining limb (100) and at least one frame retaining limb (200) may lie, in such an uninstalled position, in a substantially coplanar relationship to one another, joined by at least one flexible central area (300) having at least one anchor limb (400) joined at a non-zero angle to a central area working surface (305), wherein the anchor limb (400) further comprises at least one first anchor ridge (410) further comprising at least one first anchor barb (440) potentially releasably engagable with at least one portion of a window frame (WF). In an installed position, the device (10) may have the at least one film retaining limb (100) and the least one frame retaining limb (200) in a substantially non-coplanar relationship to one another, while, in such an installed position, the film retaining limb (100) and the anchor limb (400) may be in a substantially coplanar relationship. The at least one film retaining limb (100) may be attached to a fragment retention film (F), and the at least one frame retaining limb may be attached to a window frame (WF), while the at least one anchor limb (400) may be mechanically interlocked with at least a portion of the window frame (WF).

I claim:

1. A window film anchoring device (10) comprising;

a body (12) further comprising;

at least one film retaining limb (100) having at least one film retaining limb working surface (105) and a film retaining limb adhesive means (110) on at least a portion of the at least one film retaining limb working surface (105);

at least one frame retaining limb (200) having at least one frame retaining limb working surface (205) and a frame retaining limb adhesive means (210) on a portion of the at least one frame retaining limb working surface (205);

at least one central area (300) having at least a central area working surface (305), the at least one central area (300) disposed between the at least one film retaining limb (100) and the at least one frame retaining limb (200);

at least one anchor limb (400) confluent with the central area working surface (305), the at least one anchor limb (400) having at least one first anchor ridge (410) having a first anchor ridge axis (416) and a first anchor ridge first side (412) and a generally opposing first anchor ridge second side (414), wherein the first anchor ridge first side (412) has at least one window barb (420), the at least one first anchor ridge (410) further comprising at least one first anchor barb (440) capable of releasable engagement with at least one portion of a window frame (WF);

wherein the at least one window barb (420) has a first window barb axis (426) that is non-orthogonal to the first anchor ridge axis (416) thereby forming a window barb proximal base angle (422) and a window barb distal base angle (424) and the window barb proximal base angle (422) is an acute angle and the window barb distal base angle (424) is an obtuse angle; and wherein the at least one film retaining limb (100), the at least one frame retaining limb (200), and the at least one central area (300) all lie along a common plane.

2. The device according to claim 1, wherein the body (12) has a uniform material composition throughout.

3. The device according to claim 1, wherein the at least one anchor limb (400) further comprises a second anchor ridge (450) releasably engagable with at least one portion of a window frame (WF).

4. The device according to claim 1, wherein the body (12) further comprises a thermoplastic elastomer having a flow direction tensile strength of at least 5.0 MPa.

5. The device according to claim 1, wherein the body (12) further comprises a thermoplastic elastomer having a flow direction elongation at break of at least 350%.

6. The device according to claim 1, wherein the body (12) further comprises a thermoplastic elastomer having a cross direction tensile strength of at least 7.0 MPa.

7. The device according to claim 1, wherein the body (12) further comprises a thermoplastic elastomer having a cross direction elongation at break of at least 500%.

8. The device according to claim 1, wherein the body (12) further comprises a thermoplastic elastomer having a cross-direction unnicked tear strength of at least 35 kN/m.

9. The device according to claim 1, wherein the film retaining limb adhesive means (110) and the frame retaining limb adhesive means (210) are both a double-sided adhesive tape.

10. The device according to claim 9, wherein the double-sided adhesive tape is a heat activated double-sided adhesive tape.

11. The device according to claim 1, further comprising a second anchor ridge (450) having at least a second anchor ridge first side (452) and at least a second anchor ridge second side (454), wherein the second anchor ridge first side (452) is opposed to the first anchor ridge second side (414) and the second anchor ridge (450) has at least one anchor barb (440).

12. The device according to claim 11, wherein the second anchor ridge first side (452) has at least one anchor barb (440).

13. A window film anchoring device (10) for anchoring a fragment retention film (F) applied on a window (W) to a window frame (WF), the window film anchoring device (10) comprising, a body (12) having an uninstalled position and an installed position;

wherein in the uninstalled position the body (12) includes at least one film retaining limb (100) and at least one frame retaining limb (200) in a substantially coplanar relationship to one another, joined by at least one flexible central area (300) having a central area working surface (305) and further comprising at least one anchor limb (400) joined at a non-zero angle to the central area working surface (305), wherein the anchor limb (400) further comprises at least one first anchor ridge (410) further comprising at least one first anchor barb (440) capable of releasable engagement with at least one portion of the window frame (WF); and wherein in the installed position the body (12) is caused to transition such that the at least one film retaining limb (100) and the at least one frame retaining limb (200) are in a substantially non-coplanar relationship to one another; and the at least one film retaining limb (100) and the at least one anchor limb (400) are in a substantially coplanar relationship; and wherein the at least one film retaining limb (100) is attached to the fragment retention film (F);

the at least one frame retaining limb is attached to the window frame (WF); and the at least one anchor limb (400) is mechanically interlocked with at least a portion of the window frame (WF).

14. A window film anchoring device (10) comprising;

a body (12) further comprising;

at least one film retaining limb (100) having at least one film retaining limb working surface (105) and a film retaining limb adhesive means (110) on at least a portion of the at least one film retaining limb working surface (105);

at least one frame retaining limb (200) having at least one frame retaining limb working surface (205) and a frame retaining limb adhesive means (210) on a portion of the at least one frame retaining limb working surface (205);

at least one central area (300) having at least a central area working surface (305), the at least one central area (300) disposed between the at least one film retaining limb (100) and the at least one frame retaining limb (200);

at least one anchor limb (400) confluent with the central area working surface (305), the at least one anchor limb (400) having at least one first anchor ridge (410) having a first anchor ridge axis (416), wherein the at least one first anchor ridge (410) has a sagittate-shaped combined anchor profile (460) having a first basal lobe (462) and a second basal lobe (464), wherein the first basal lobe (462) further comprises a window barb (420) and the second basal lobe (464) further comprises an anchor barb (440), wherein the first basal lobe (462) and the second basal lobe (464) are asymmetric about the first anchor ridge axis (416), wherein the anchor barb (440) is capable of releasable engagement with at least one portion of a window frame (WF); and wherein the at least one film retaining limb (100), the at least one frame retaining limb (200), and the at least one central area (300) all lie along a common plane.

15. A window film anchoring device (10) comprising;

a body (12) further comprising;

at least one film retaining limb (100) having at least one film retaining limb working surface (105) and a film retaining limb adhesive means (110) on at least a portion of the at least one film retaining limb working surface (105);

at least one frame retaining limb (200) having at least one frame retaining limb working surface (205) and a frame retaining limb adhesive means (210) on a portion of the at least one frame retaining limb working surface (205);

at least one central area (300) having at least a central area working surface (305), the at least one central area (300) disposed between the at least one film retaining limb (100) and the at least one frame retaining limb (200);

at least one anchor limb (400) confluent with the central area working surface (305), the at least one anchor limb (400) having at least one first anchor ridge (410) having a first anchor ridge first side (412) and a generally opposing first anchor ridge second side (414), wherein the first anchor ridge first side (412) has more than one window barb (420), the at least one first anchor ridge further comprising at least one first anchor barb (440) capable of releasable engagement with at least one portion of a window frame (WF); and wherein the at least one film retaining limb (100), the at least one frame retaining limb (200), and the at least one central area (300) all lie along a common plane.

* * * * *